US011185111B2

(12) United States Patent
Fu et al.

(10) Patent No.: US 11,185,111 B2
(45) Date of Patent: Nov. 30, 2021

(54) VAPORIZATION DEVICE

(71) Applicant: SHENZHEN RELX TECHNOLOGY CO., LTD., Shenzhen (CN)

(72) Inventors: Yao Fu, Shenzhen (CN); Zugang Yang, Shenzhen (CN); Xingming Tao, Shenzhen (CN); Jin Zhang, Shenzhen (CN); Shuting Feng, Shenzhen (CN)

(73) Assignee: SHENZHEN RELX TECHNOLOGY CO., LTD., Shenzhen (CN)

( * ) Notice: Subject to any disclaimer, the term of this patent is extended or adjusted under 35 U.S.C. 154(b) by 66 days.

(21) Appl. No.: 16/729,641

(22) Filed: Dec. 30, 2019

(65) Prior Publication Data

US 2021/0145052 A1 May 20, 2021

(30) Foreign Application Priority Data

Nov. 19, 2019 (CN) ..... 201911136490.7

(51) Int. Cl.
*A24F 40/42* (2020.01)
*A24F 40/10* (2020.01)
*A24F 40/46* (2020.01)

(52) U.S. Cl.
CPC ..... *A24F 40/42* (2020.01); *A24F 40/10* (2020.01); *A24F 40/46* (2020.01)

(58) Field of Classification Search
None
See application file for complete search history.

(56) References Cited

U.S. PATENT DOCUMENTS

| | | | | |
|---|---|---|---|---|
| 9,986,769 | B1 | 6/2018 | Liu et al. | |
| 2018/0168231 | A1* | 6/2018 | Reevell | A61M 11/042 |
| 2019/0142070 | A1 | 5/2019 | Robinson et al. | |
| 2021/0120873 | A1* | 4/2021 | Adair | A24F 40/10 |

FOREIGN PATENT DOCUMENTS

| | | | |
|---|---|---|---|
| CN | 203897285 | U | 10/2014 |
| CN | 109512037 | A | 3/2019 |
| CN | 109717519 | A | 5/2019 |
| CN | 209090052 | U | 7/2019 |
| CN | 110313647 | A | 10/2019 |
| CN | 110353320 | A | 10/2019 |
| CN | 209769001 | U | 12/2019 |
| CN | 111165878 | A | 5/2020 |
| CN | 111165879 | A | 5/2020 |

OTHER PUBLICATIONS

International Search Report of corresponding PCT Patent Application No. PCT/CN2019/119358 dated Aug. 25, 2020.

* cited by examiner

*Primary Examiner* — James Harvey
(74) *Attorney, Agent, or Firm* — Idea Intellectual Limited; Margaret A. Burke; Sam T. Yip

(57) ABSTRACT

This application relates to a vaporization device. The provided vaporization device includes a body housing, a first bracket, a second bracket, and a connecting member. The connecting member includes an opening, the first bracket includes an opening, and a direction in which the opening of the connecting member extends and a direction in which the opening of the first bracket extends do not overlap.

20 Claims, 12 Drawing Sheets

VAPORIZATION DEVICE

CROSS REFERENCE TO RELATED APPLICATIONS

The present application claims the benefit of priority from the China Patent Application No. 201911136490.7, filed on 19 Nov. 2019, the disclosure of which is hereby incorporated by reference in its entirety.

BACKGROUND OF THE INVENTION

1. Field of the Invention

The present disclosure generally relates to a vaporization device, and in particular, to an electronic device that provides inhalable aerosol.

2. Description of the Related Art

An e-cigarette is an electronic product that heats a vaporizable solution and vaporizes the solution to generate aerosol for a user to inhale. In recent years, major manufacturers begin to produce various e-cigarette products. Generally, an e-cigarette product includes a housing, an e-liquid storage chamber, a vaporization chamber, a heating component, an air inlet, an airflow channel, an air outlet, a power supply device, a sensing device, and a control device. The e-liquid storage chamber is configured to store a vaporizable solution, and the heating component is configured to heat the vaporizable solution and vaporize the solution to generate aerosol. The air inlet is in communication with the vaporization chamber, and air is supplied to the heating component when a user inhales. The aerosol generated by the heating component is first generated in the vaporization chamber, then flows through the airflow channel and the air outlet, and is finally inhaled by the user. The power supply device supplies power needed by the heating component, and the control device controls a heating time of the heating component based on an inhalation action of the user detected by the sensing device. The housing wraps each of the foregoing components.

Existing e-cigarette products may use a sensor to detect the inhalation action of the user. To detect the airflow, the sensor has a portion that is in communication with the airflow channel. The vaporizable solution or condensed liquid may infiltrate a portion of which the sensor is in communication with the airflow channel during use, causing the sensor to malfunction or fail.

In addition, pressure balance of the e-liquid storage chamber is not taken into account for the existing e-cigarette product. In the existing e-cigarette product, the e-liquid storage chamber is generally designed to be completely sealed to prevent the vaporizable solution from leaking. As users continue to use e-cigarette products, the vaporizable solution in the e-liquid storage chamber is continuously consumed and reduced, causing a decrease in the pressure and form a negative pressure in the e-liquid storage chamber. The negative pressure causes the vaporizable solution in the e-liquid storage chamber to be difficult to flow uniformly to the heating component, and the heating component does not uniformly adsorb the vaporizable solution. In this case, when the temperature of the heating component rises, there will be a high probability of dry boiling and scorching, thus resulting in a poor user experience.

Therefore, a vaporization device that can resolve the foregoing problem is provided.

SUMMARY OF THE INVENTION

A vaporization device is provided. The provided vaporization device includes a body housing, a first bracket, a connecting member, and a second bracket. The body housing includes a receiving portion. The first bracket is disposed in the body housing and includes a first groove, a second groove, a third groove, and a first opening adjacent to the second groove. The connecting member is disposed in the first groove of the first bracket and includes a first opening. The second bracket is disposed in the third groove of the first bracket. The first opening of the connecting member extends in a direction of a first axis, and the first opening of the first bracket extends in a direction of a second axis. The first axis and the second axis do not overlap.

A vaporization device is provided. The provided vaporization device includes a body housing, a first bracket, and a connecting member. The first bracket is disposed in the body housing and includes a first groove, a second groove, and a first opening adjacent to the second groove. The connecting member is disposed in the first groove and includes a first opening. The first opening of the connecting member does not extend through the first opening of the first bracket.

BRIEF DESCRIPTION OF THE DRAWINGS

The aspects of the present disclosure will become more comprehensible from the following detailed description made with reference to the accompanying drawings. It should be noted that, various features may not be drawn to scale, and the sizes of the various features may be increased or reduced arbitrarily for the purpose of clear description.

The drawings and detailed descriptions use the same reference numerals to indicate same or similar elements. The features of the present disclosure will be clearer from the detailed descriptions made with reference to the accompanying drawings.

PREFERRED EMBODIMENT OF THE PRESENT INVENTION

Figure 1:
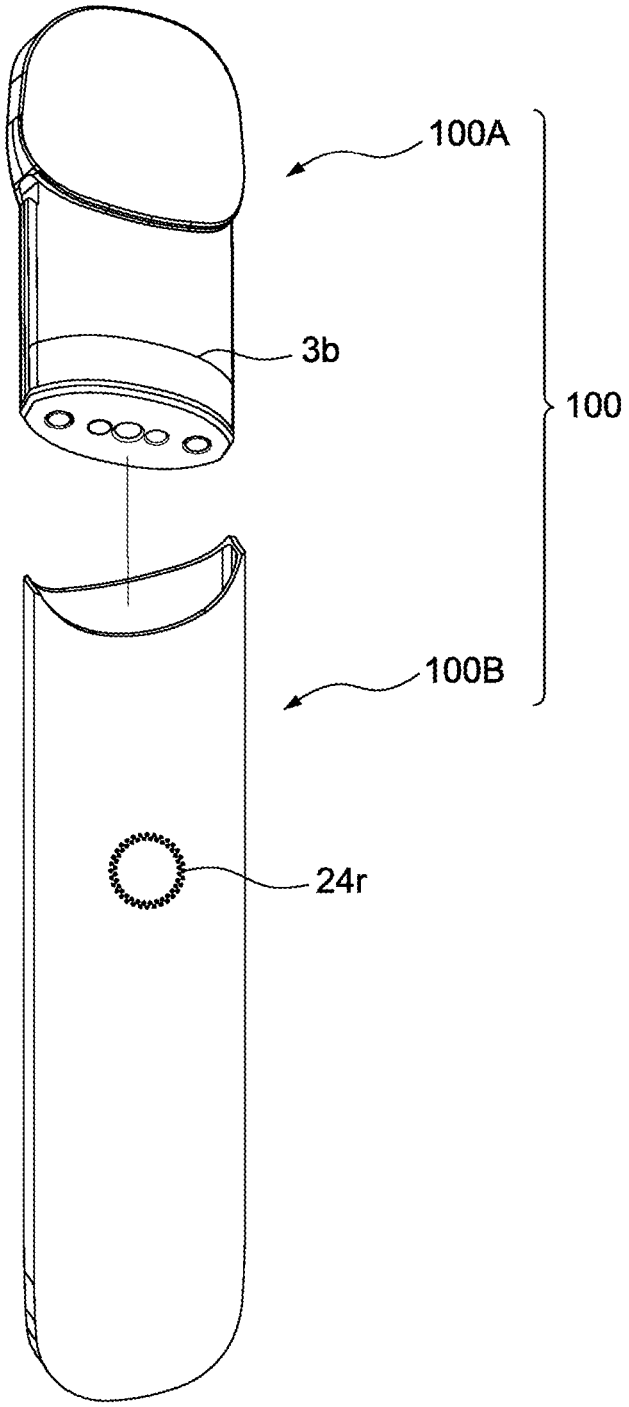
FIG. 1 is an assembly view of a vaporization device according to some embodiments of the present disclosure.

The following disclosure provides many different embodiments or examples for implementing different features of the provided subject matter. The following disclosed content provides many different embodiments or examples of different features used to implement the provided subject matters. Certainly, these are merely examples and are not intended to be limitative. In the disclosure, in the following descriptions, reference formed by the first feature above or on the second feature may include an embodiment formed by direct contact between the first feature and the second feature, and may further include an embodiment in which an additional feature may be formed between the first feature and the second feature to enable the first feature and the second feature to be not in direct contact. In addition, in the disclosure, reference numerals and/or letters may be repeated in examples. This repetition is for the purpose of simplification and clarity, and does not indicate a relationship between the described various embodiments and/or configurations.

The embodiments of the disclosure are described in detail below. However, it should be understood that, the disclosure provides many applicable concepts that can be implemented in various particular cases. The described particular embodiments are only illustrative and do not limit the scope of the disclosure.

FIG. 1 is an assembly view of a vaporization device according to some embodiments of the present disclosure.

A vaporization device 100 may include a cartridge 100A and a body 100B. In some embodiments, the cartridge 100A and the body 100B may be designed as a whole. In some embodiments, the cartridge 100A and the body 100B may be designed as two separate components. In some embodiments, the cartridge 100A may be designed to be removably engaged with the body 100B. In some embodiments, the cartridge 100A may be designed to be partially received in the body 100B.

The body 100B may include a plurality of components. Although not shown in FIG. 1, the body 100B may include components such as a conductive pogo pin, a sensor, a circuit board, a light guide component, a buffer component, a power supply component (for example, but not limited to a battery or a rechargeable battery), a power supply component bracket, a motor, a charging panel or the like that may be required during the operation of the vaporization device 100. Various components that may be included in the body 100B will be described in the following paragraphs with reference to FIG. 5A and FIG. 5B.

The body 100B may supply power to the cartridge 100A. The power supplied by the body 100B to the cartridge 100A may heat a vaporizable material stored in the cartridge 100A. The vaporizable material may be liquid. The vaporizable material may be a solution. In subsequent paragraphs of the present disclosure, the vaporizable material may also be referred to as e-liquid. The e-liquid is edible.

Figure 2A:
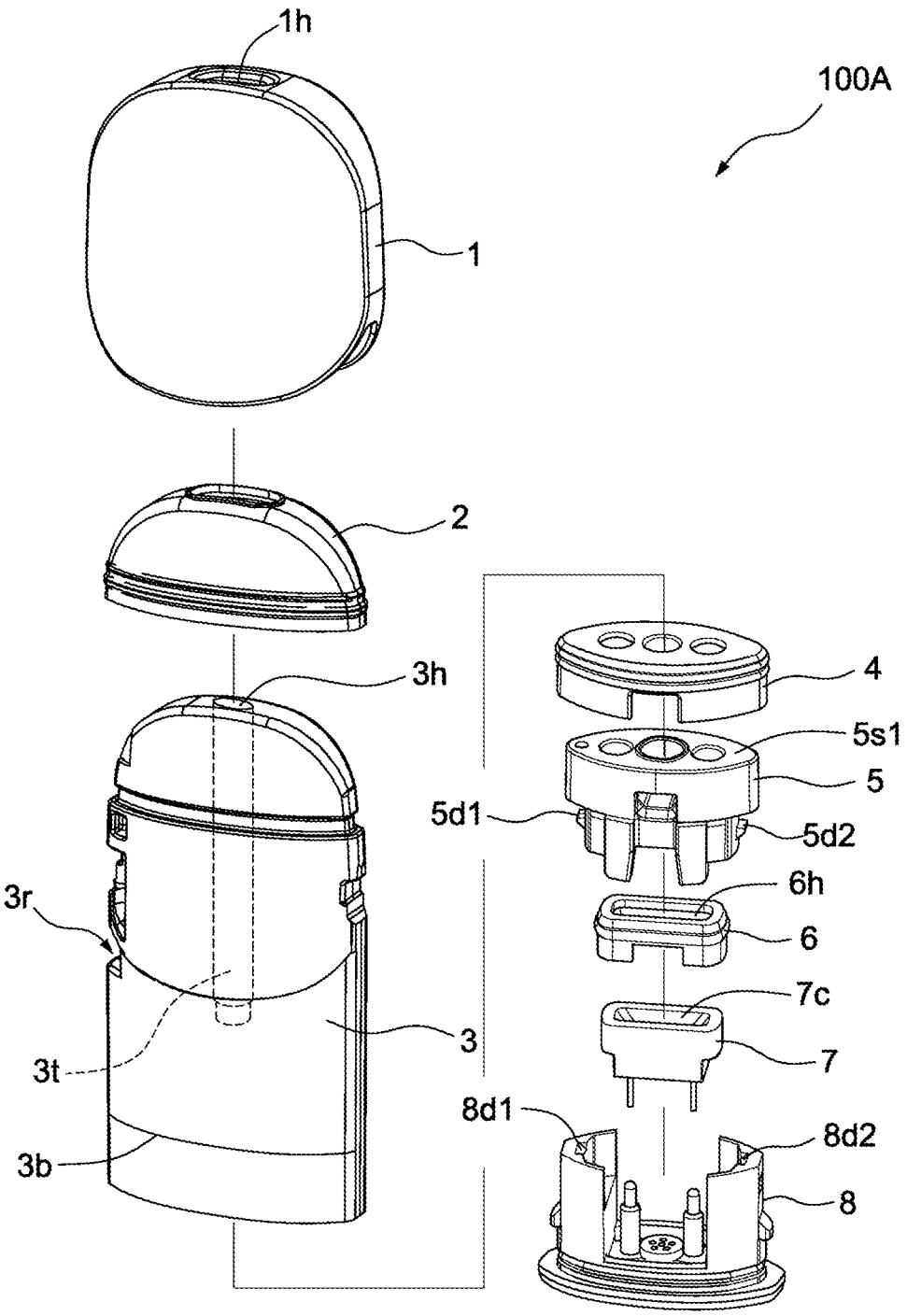
FIG. 2A and FIG. 2B are exploded views of a cartridge according to some embodiments of the present disclosure.
Figure 2B:
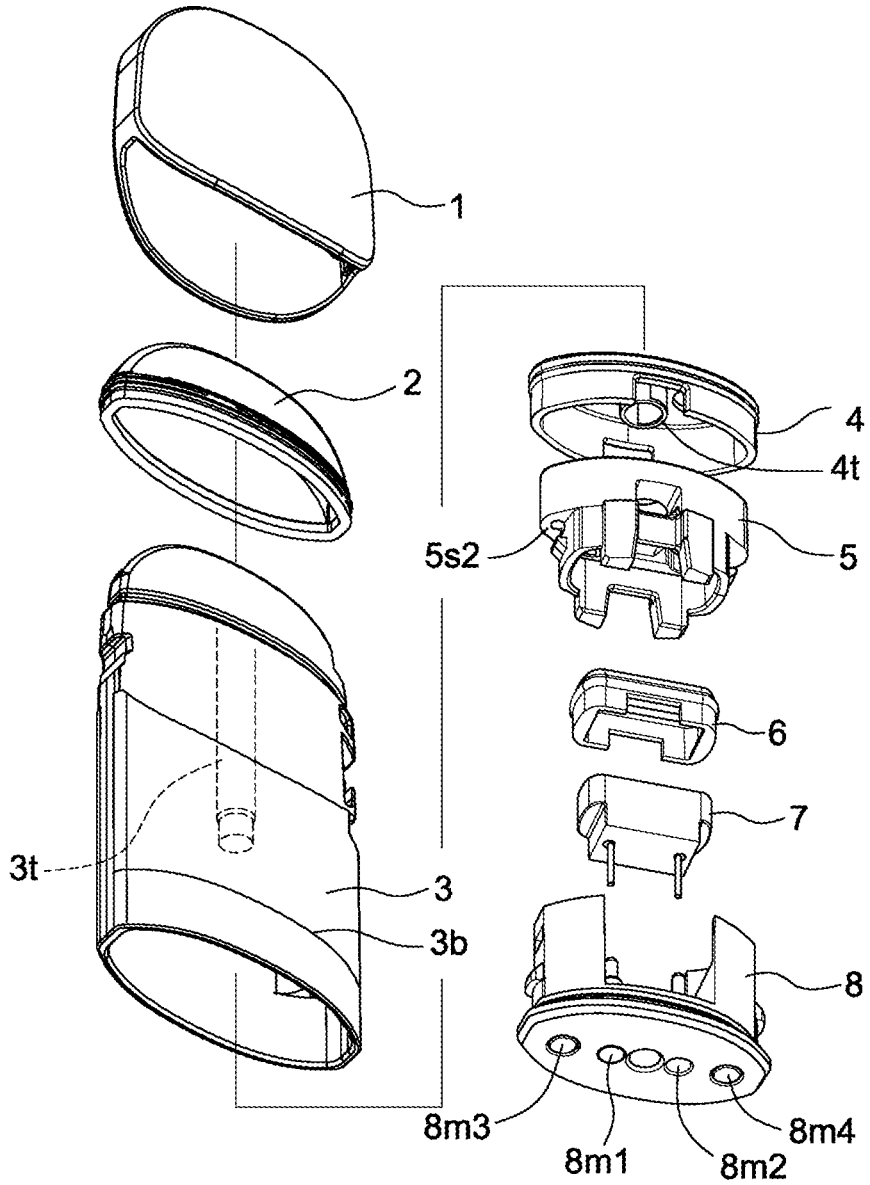

FIG. 2A and FIG. 2B are exploded views of a cartridge according to some embodiments of the present disclosure.

A cartridge 100A includes a mouthpiece 1, a mouthpiece sealing member 2, a sealing member 3, a cartridge housing 3, a top cap sealing component 4, a heating component top cap 5, a sealing component 6, a heating component 7, and a heating component base 8. A bottom surface of the heating component 7 may be provided with a heating circuit (not shown in the figure). In some embodiments, the heating circuit may be partially disposed inside the heating component 7 (not shown in the figure).

As shown in FIG. 2A, the mouthpiece 1 is disposed on the cartridge housing 3. The mouthpiece 1 covers a portion of the cartridge housing 3. The mouthpiece 1 exposes a portion of the cartridge housing 3. In some embodiments, the mouthpiece 1 may be made of an opaque material, and a portion of the cartridge housing 3 that is covered by the mouthpiece 1 cannot be seen from an exterior of the mouthpiece 1. In some embodiments, the mouthpiece 1 may be made of a transparent material, and a portion of the cartridge housing 3 that is covered by the mouthpiece 1 may be seen from the exterior of the mouthpiece 1.

The mouthpiece 1 has an opening 1*h* at a top. The mouthpiece sealing member 2 is disposed between the mouthpiece 1 and the cartridge housing 3. The mouthpiece sealing member 2 may prevent liquid from leaking into a gap between the mouthpiece 1 and the cartridge housing 3. The mouthpiece sealing member 2 may prevent liquid from flowing from the opening 1*h* to a surface of the cartridge housing 3 along the gap between the mouthpiece 1 and the cartridge housing 3.

A tube 3*t* is disposed inside the cartridge housing 3. The tube 3*t* extends to the top cap sealing component 4 from an opening 3*h* of the cartridge housing 3. The tube 3*t* extends to the heating component top cap 5 from the opening 3*h*. In some embodiments, the tube 3*t* may be seen from the cartridge housing 3. In some embodiments, the tube 3*t* cannot be seen from the outside of the cartridge housing 3. In some embodiments, a portion of the tube 3*t* may be seen from the exterior of the cartridge housing 3. In some embodiments, a portion of the tube 3*t* is blocked by the mouthpiece 1 and cannot be seen from an exterior of the cartridge 100A.

As shown in FIG. 2A, the top cap sealing component 4 may have a plurality of openings. The heating component top cap 5 may have a plurality of openings. In some embodiments, a quantity of openings of the top cap sealing component 4 may be the same as a quantity of openings of the heating component top cap 5. In some embodiments, a quantity of openings of the top cap sealing component 4 may be different from a quantity of openings of the heating component top cap 5. In some embodiments, a quantity of openings of the top cap sealing component 4 may be less than a quantity of openings of the heating component top cap 5. In some embodiments, a quantity of openings of the top cap sealing component 4 may be greater than a quantity of openings of the heating component top cap 5.

In some embodiments, the top cap sealing component 4 may have elasticity. In some embodiments, the top cap sealing component 4 may have flexibility. In some embodiments, the top cap sealing component 4 may include silica gel. In some embodiments, the top cap sealing component 4 may be made of silica gel.

The heating component top cap 5 may have a surface 5*s*1 and a surface 5*s*2 opposite to the surface 5*s*1. The heating component top cap 5 may have buckle portions 5*d*1 and 5*d*2. The heating component base 8 may have buckle portions 8*d*1 and 8*d*2. The heating component top cap 5 and the heating component base 8 may be coupled using the buckle portions 5*d*1, 5*d*2, 8*d*1, and 8*d*2. The heating component top cap 5 and the heating component base 8 may be mechanically coupled using the buckle portions 5*d*1, 5*d*2, 8*d*1, and 8*d*2. The heating component top cap 5 and the heating component base 8 may be removably coupled using the buckle portions 5*d*1, 5*d*2, 8*d*1, and 8*d*2.

When a portion or all of the components of the cartridge 100A are coupled to each other, the top cap sealing component 4 may cover a portion of the heating component top cap 5. The top cap sealing component 4 may surround a portion of the heating component top cap 5. The top cap sealing component 4 may expose a portion of the heating component top cap 5.

When a portion or all of the components of the cartridge 100A are coupled to each other, the sealing component 6 may cover a portion of the heating component 7. The sealing component 6 may surround a portion of the heating component 7. The sealing component 6 may expose a portion of the heating component 7.

In some embodiments, the sealing component 6 may have elasticity. In some embodiments, the sealing component 6 may have flexibility. In some embodiments, the sealing component 6 may include silica gel. In some embodiments, the sealing component 6 may be made of silica gel. The sealing component 6 can withstand high temperatures. In some embodiments, the sealing component 6 has a melting point greater than 350 degrees Celsius.

As shown in FIG. 2A, the sealing component 6 has an opening 6*h*, and the heating component 7 has a groove 7*c*. When the sealing component 6 and the heating component 7 are coupled to each other, the opening 6*h* may expose at least one portion of the groove 7*c*.

As shown in FIG. 2B, the top cap sealing component 4 may have an extending portion 4*t*. When the top cap sealing component 4 and the heating component top cap 5 are coupled to each other, the extending portion 4*t* extends into a channel in the heating component top cap 5.

In some embodiments, the mouthpiece 1 and the cartridge housing 3 may be made of a same material. In some embodiments, the mouthpiece 1 and the cartridge housing 3 may be made of different materials.

A groove 3*r* is disposed on a side face of the cartridge housing 3. After the mouthpiece 1 and the mouthpiece sealing member 2 are assembled to the cartridge housing 3, the groove 3*r* is still visible. The cartridge housing 3 has a non-circular cross section. In some embodiments, the cartridge housing 3 may include a plastic material. In some embodiments, the cartridge housing 3 may be made of a plastic material. In some embodiments, the cartridge housing 3 may be made of a transparent plastic material.

There is a strip 3*b* near a bottom end of the cartridge housing 3. The strip 3*b* may be made of a same material as the cartridge housing 3. The strip 3*b* may be made of a material different from the cartridge housing 3. In some embodiments, the strip 3*b* may include a metal material. In some embodiments, the strip 3*b* may be made of a metal material. In some embodiments, the strip 3*b* may be made of a transparent material. In some embodiments, the strip 3*b* may be made of an opaque material.

As shown in FIG. 2B, the heating component base 8 includes metal pads 8*m*1, 8*m*2, 8*m*3, and 8*m*4. The metal pads 8*m*1 and 8*m*2 are electrically connected to pins of the heating component 7. The metal pads 8*m*1 and 8*m*2 may be configured to supply power to the heating component. The metal pads 8*m*3 and 8*m*4 may allow the cartridge 100A to be detachably coupled to a magnetic component disposed in the body 100B.

Figure 3A:
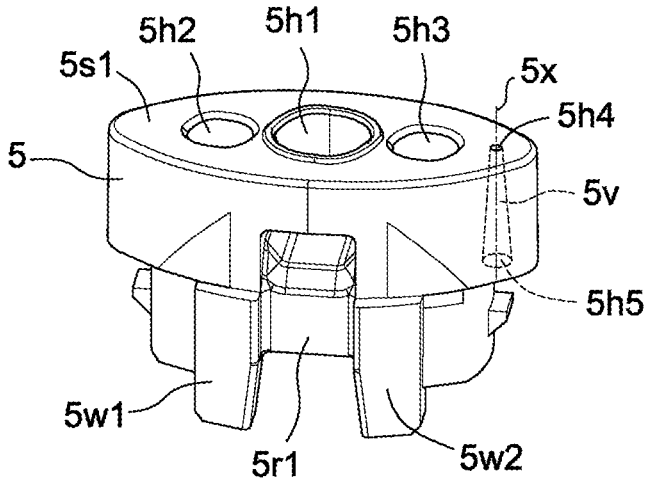
FIG. 3A and FIG. 3B are three-dimensional views of a heating component top cap according to some embodiments of the present disclosure.
Figure 3B:
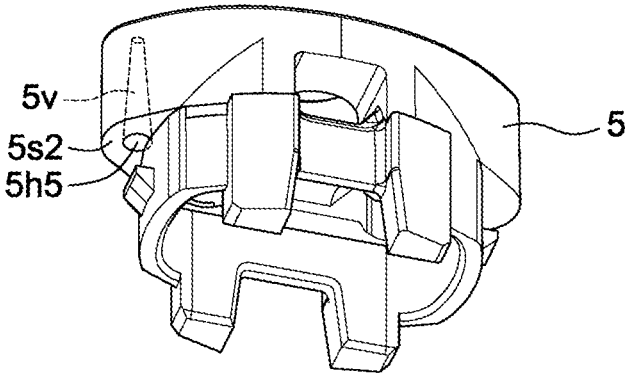

FIG. 3A and FIG. 3B are three-dimensional views of a heating component top cap according to some embodiments of the present disclosure.

Figure 3C:
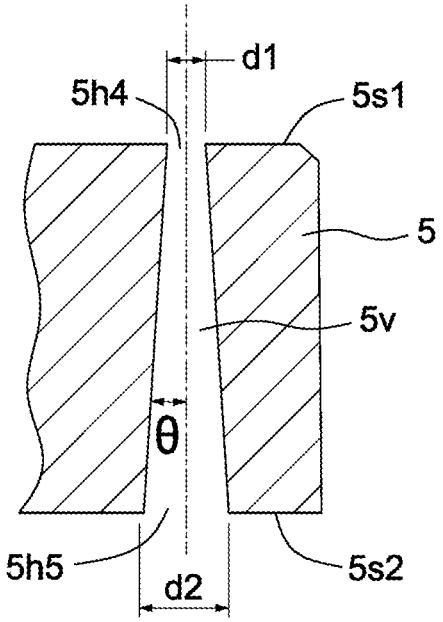
FIG. 3C is a three-dimensional view of a channel in a heating component top cap according to some embodiments of the present disclosure.

FIG. 3C is a three-dimensional view of a channel in a heating component top cap according to some embodiments of the present disclosure.

Figure 4A:
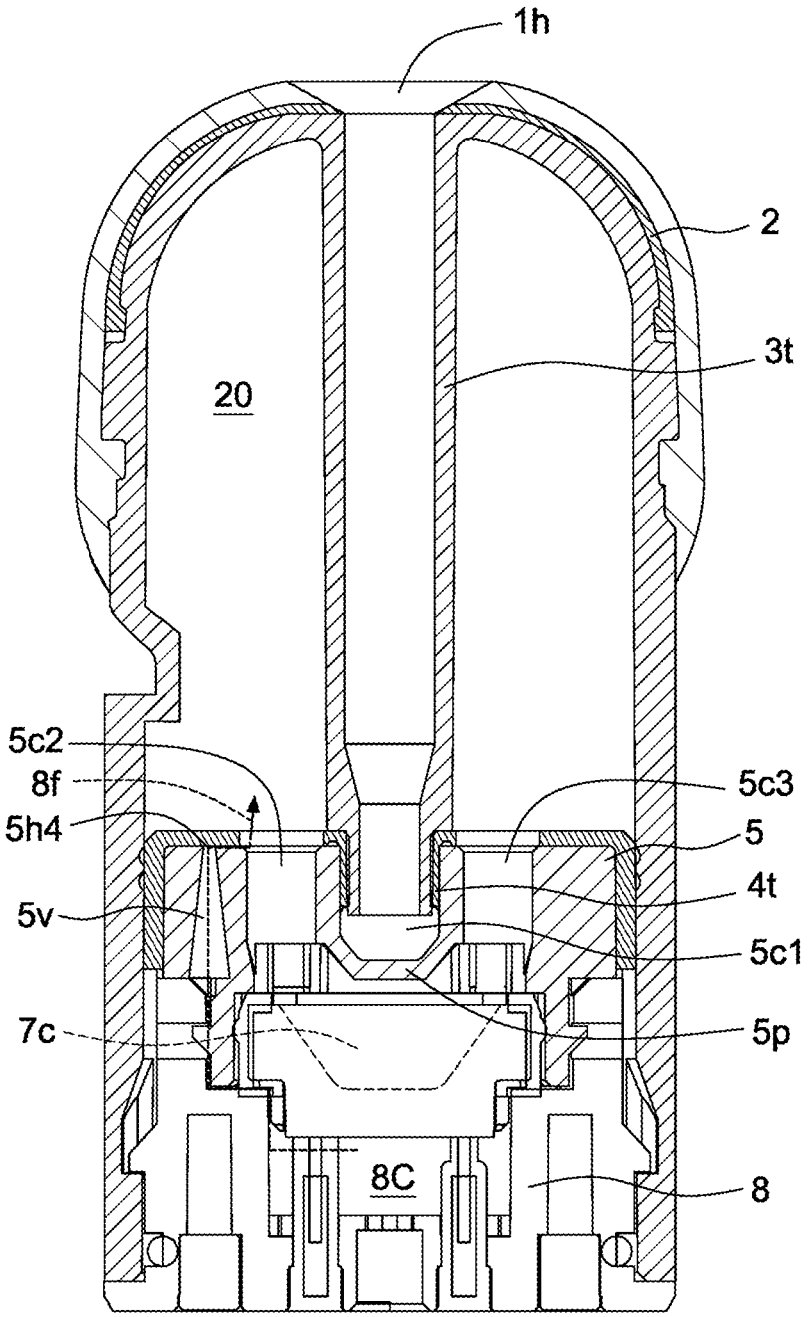
FIG. 4A and FIG. 4B are sectional views of a cartridge according to some embodiments of the present disclosure.

A heating component top cap 5 has openings 5*h*1, 5*h*2, 5*h*3, and 5*h*4 on a surface 5*s*1. The opening 5*h*1 extends into the heating component top cap 5 to form a channel (a channel 5*c*1 as shown in FIG. 4A). The opening 5*h*2 extends into the heating component top cap 5 to form a channel (a channel 5*c*2 as shown in FIG. 4A). The opening 5*h*3 extends into the heating component top cap 5 to form a channel (a channel 5*c*3 as shown in FIG. 4A). The opening 5*h*4 extends into the heating component top cap 5 to form a channel (a channel 5*v* as shown in FIG. 4A). In some embodiments, the heating component top cap 5 may have more channels. In some embodiments, the heating component top cap 5 may have fewer channels.

The heating component top cap 5 has columnar portions 5*w*1 and 5*w*2. A groove 5*r*1 is defined between the columnar portion 5*w*1 and the columnar portion 5*w*2. The groove 5*r*1 is in fluid communication with the opening 5*h*1. The groove 5*r*1 is in fluid communication with the channel 5*c*1 (as shown in FIG. 4A) of the heating component top cap 5. The groove 5*r*1 is in fluid communication with a vaporization chamber 8C (as shown in FIG. 4A).

As shown in FIG. 3B, the heating component top cap 5 has an opening 5*h*5 on a surface 5*s*2. The opening 5*h*4 penetrates the heating component top cap 5 from the surface 5*s*1 to the opening 5*h*5 of the surface 5*s*2, to form a channel 5*v*. In some embodiments, a center point of the opening 5*h*4 and a center point of the opening 5*h*5 may be aligned with each other in a vertical direction. In some embodiments, a center point of the opening 5*h*4 and a center point of the opening 5*h*5 may be unaligned with each other in a vertical direction.

The opening 5*h*4 on the surface 5*s*1 has a diameter d1. The opening 5*h*5 on the surface 5*s*2 has a diameter d2. In some embodiments, the diameter d1 is different from the diameter d2. In some embodiments, the diameter d1 is less than the diameter d2. In some embodiments, the diameter d1 may be identical to the diameter d2. In some embodiments, the diameter d1 is in a range of about 0.3 mm to 0.4 mm. In some embodiments, the diameter d1 is in a range of about 0.4 mm to 0.6 mm.

In some embodiments, an inner diameter of the channel 5*v* gradually increases in a direction from the surface 5*s*1 to the surface 5*s*2. In some embodiments, an inner diameter of the channel 5*v* monotonically increases in a direction from the surface 5*s*1 to the surface 5*s*2. In some embodiments, an inner wall of the channel 5*v* includes a smooth surface.

As shown in FIG. 3C, an axis 5*x* passes through the center point of the opening 5*h*4 and the center point of the opening 5*h*5. The axis 5*x* is substantially perpendicular to the surface 5*s*1. There is an angle θ between the inner wall of the channel 5*v* and the vertical axis 5*x*. In some embodiments, the angle θ is in a range of 3° to 4°. In some embodiments, the angle θ is in a range of 4° to 5°. In some embodiments, the angle θ is in a range of 5° to 6°. In some embodiments, the angle θ is in a range of 6° to 7°. In some embodiments, the angle θ is in a range of 7° to 10°. In some embodiments, the angle θ is in a range of 3° to 15°.

Figure 3D:
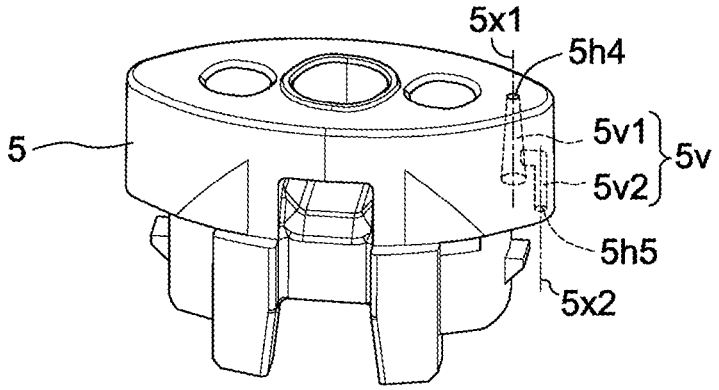
FIG. 3D and FIG. 3E are three-dimensional views of a heating component top cap according to some embodiments of the present disclosure.
Figure 3E:
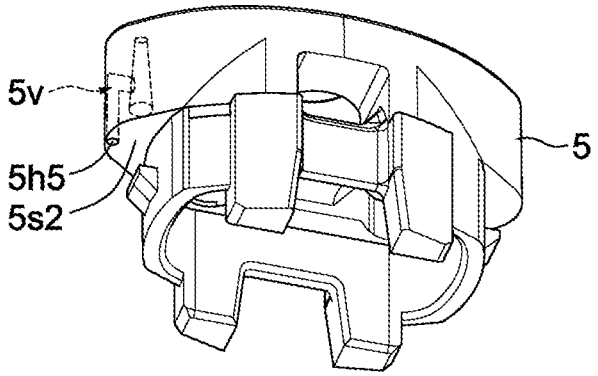

FIG. 3D and FIG. 3E are three-dimensional views of a heating component top cap according to some embodiments of the present disclosure.

Figure 3F:
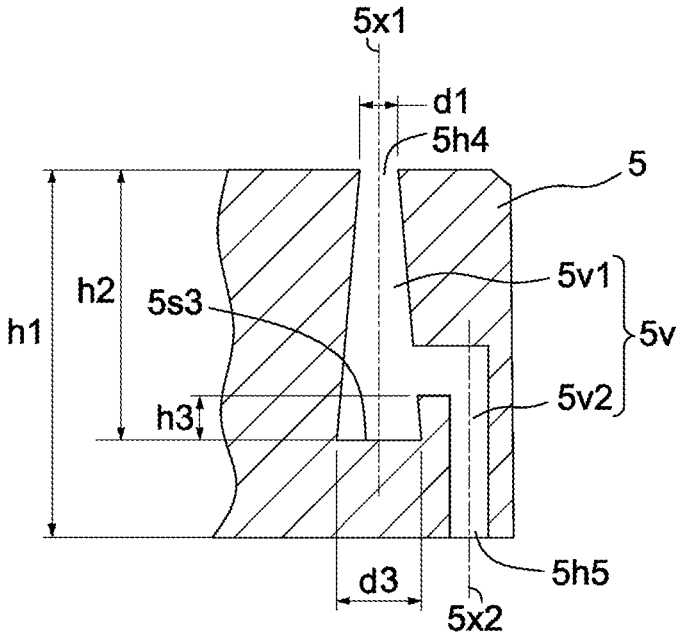
FIG. 3F is a three-dimensional view of a channel in a heating component top cap according to some embodiments of the present disclosure.

FIG. 3F is a three-dimensional view of a channel in a heating component top cap according to some embodiments of the present disclosure.

Referring to FIG. 3D to FIG. 3F, a heating component top cap 5 may have a channel 5*v*. The channel 5*v* may include a first portion 5*v*1 and a second portion 5*v*2. The first portion 5*v*1 and the second portion 5*v*2 are in fluid communication with each other. In some embodiments, the channel 5*v* may include more portions that are in communication with each other. As shown in FIG. 3C, the first portion 5*v*1 extends in a direction of an axis 5*x*1, and the second portion 5*v*2 extends in a direction of an axis 5*x*2. The axis 5*x*1 is substantially perpendicular to the surface 5*s*1. The axis 5*x*2 is substantially perpendicular to the surface 5*s*1. The axis 5*x*1 and the axis 5*x*2 do not overlap each other. The opening 5*h*4 and the opening 5*h*5 do not overlap in a direction perpendicular to the surface 5*s*1.

The first portion 5*v*1 extends into the heating component top cap 5 from the opening 5*h*4 on the surface 5*s*1. The first portion 5*v*1 extends toward a surface 5*s*2 by a distance h2 from the surface 5*s*1. The distance h2 is less than a distance h1 between the surface 5*s*1 and the surface 5*s*2. The first portion 5*v*1 has a bottom surface 5*s*3 inside the heating component top cap 5, and the bottom surface 5*s*3 has a diameter d3.

In some embodiments, the diameter d1 is different from the diameter d3. In some embodiments, the diameter d1 is less than the diameter d3. In some embodiments, the diameter d1 may be identical to the diameter d3. In some embodiments, an inner diameter of the first portion 5*v*1 gradually increases in a direction from the surface 5*s*1 to the bottom surface 5*s*3. In some embodiments, an inner diameter of the first portion 5*v*1 monotonically increases in a direction from the surface 5*s*1 to the bottom surface 5*s*3. In some embodiments, an inner wall of the first portion 5*v*1 includes a smooth surface.

In some embodiments, the second portion 5*v*2 may have a uniform inner diameter. In some embodiments, the inner diameter of the second portion 5*v*2 is identical to a diameter of the opening 5*h*5. In some embodiments, the inner diameter of the second portion 5*v*2 may be different from the diameter of the opening 5*h*5.

Referring to FIG. 3F, there is a distance h3 between a joint of the second portion 5*v*2 and the first portion 5*v*1 and the bottom surface 5*s*3. In some embodiments, the distance h3 is not zero. In some embodiments, a ratio of the distance h3 to the distance h2 is in a range of 0.1 to 0.5. In some embodiments, a ratio of the distance h3 to the distance h2 is in a range of 0.5 to 0.9.

The heating component top cap 5 has the opening 5*h*5 on the surface 5*s*2. Airflow may reach the opening 5*h*4 on the surface 5*s*1 from the opening 5*h*5 through the second portion 5*v*2 and the first portion 5*v*1.

Figure 4B:
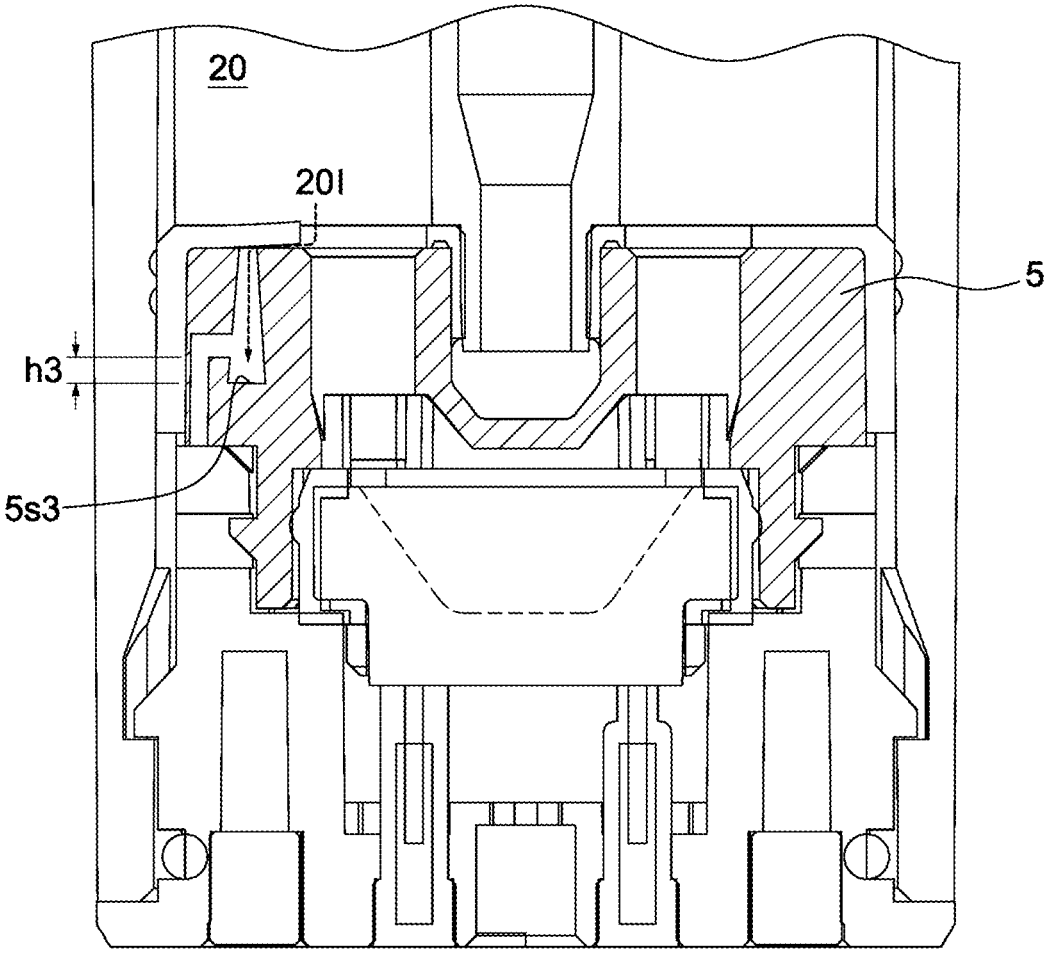

FIG. 4A and FIG. 4B are sectional views of a cartridge according to some embodiments of the present disclosure.

As shown in FIG. 4A, a mouthpiece 1 has an opening 1*h*. A cartridge housing 3 has a tube 3*t* extending toward a top cap sealing component 4 from the opening 1*h*. The tube 3*t*, the top cap sealing component 4, and the cartridge housing 3 define a liquid storage tank 20. Vaporizable materials may be stored in the liquid storage tank 20.

The tube 3*t* may have a portion extending into a channel 5*c*1. The tube 3*t* may have a non-uniform outer diameter. As shown in FIG. 4A, the portion that is of the tube 3*t* and that extends into the channel 5*c*1 has a relatively small outer diameter. The tube 3*t* may have a non-uniform inner diameter. As shown in FIG. 4A, the portion that is of the tube 3*t* and that extends into the channel 5*c*1 has a relatively small inner diameter.

The tube 3*t* is coupled to the channel 5*c*1 via an opening 5*h*1 of a heating component top cap 5. The tube 3*t* is in fluid communication with the channel 5*c*1 via the opening 5*h*1 of the heating component top cap 5. The channel 5*c*1 is isolated from the liquid storage tank 20 via the tube 3*t*.

As shown in FIG. 4A, the top cap sealing component 4 may expose openings 5*h*1, 5*h*2, and 5*h*3 of the heating component top cap 5. The top cap sealing component 4 does not cover the openings 5*h*1, 5*h*2, and 5*h*3 of the heating component top cap 5. The top cap sealing component 4 does not block channels 5*c*1, 5*c*2, and 5*c*3.

The channel 5*c*2 is in fluid communication with a groove 7*c* of a heating component 7. The channel 5*c*3 is in fluid communication with the groove 7*c* of the heating component 7. E-liquid stored in the liquid storage tank 20 may flow into the groove 7*c* through the channel 5*c*2. The e-liquid stored in the liquid storage tank 20 may flow into the groove 7*c* through the channel 5*c*3. The groove 7*c* of the heating component 7 is in fluid communication with the liquid storage tank 20. The e-liquid may be in full contact with the heating component 7 in the groove 7*c*. A heating circuit on a surface of or inside the heating component 7 may heat the e-liquid and generate aerosol.

A vaporization chamber 8C is defined between a heating component base 8 and the heating component 7. The heating component 7 is partially exposed to the vaporization chamber 8C. The aerosol generated through heating by the heating component 7 is formed in the vaporization chamber 8C. The aerosol generated through heating by the heating component 7 is sucked by a user via the tube 3*t* and the opening 1*h*. The tube 3*t* is in fluid communication with the vaporization chamber 8C. A groove 5*r*1 (refer to FIG. 3A) is in fluid communication with the vaporization chamber 6C.

The top cap sealing component 4 may cover an opening 5*h*4 of the heating component top cap 5. The top cap sealing component 4 may block a channel 5*v*.

As shown in FIG. 4A, the heating component top cap 5 has a blocking member 5*p*. The blocking member 5*p* isolates the tube 3*t* from the groove 7*c* of the heating component 7. The blocking member 5*p* isolates the channel 5*c*1 from the groove 7*c* of the heating component 7.

During use of a vaporization device, when a condensed liquid remaining in the tube 3*t* reaches a specific volume, the condensed liquid may slip from the tube 3*t*. The blocking member 5*p* may prevent the condensed liquid slipping from the tube 3*t* from being in contact with the heating component 7. The blocking member 5*p* may prevent the heating component 7 from being contaminated by the slipped condensed liquid. The blocking member 5*p* may prevent the slipped condensed liquid from changing a taste of the aerosol. The blocking member 5*p* may prevent liquid from splashing due to the condensed liquid slipping to a high-temperature heating component. The blocking member 5*p* may prevent the splashed liquid from scalding the user.

FIG. 4A shows airflow 8*f* from the vaporization chamber 8C to the liquid storage tank 20.

When the vaporization device is idle and not sucked by the user, the opening 5*h*4 is closely engaged with the top cap sealing component 4, and the e-liquid in the liquid storage tank 20 does not leak from the channel 5*v*.

As the user continues to use the vaporization device, a vaporizable solution in the liquid storage tank 20 is continuously consumed and reduced, so that a pressure in the liquid storage tank 20 gradually decreases. A decrease in the pressure in the liquid storage tank 20 may generate a negative pressure. The decrease in the pressure in the liquid storage tank 20 may make it difficult for a volatile solution to flow through the channels 5*c*1 and 5*c*2 to the groove 7*c* of the heating component 7. When the groove 7*c* does not completely adsorb the volatile solution, the high-temperature heating component 7 may boil dry and generate scorched flavor.

The foregoing problem may be alleviated through the channel 5*v* disposed in the heating component top cap 5. The channel 5*v* disposed in the heating component top cap 5 is in fluid communication with the vaporization chamber 8C, which may balance the pressure in the liquid storage tank 20.

Because the vaporization chamber 8C is in fluid communication with the tube 3*t*, a pressure in the vaporization chamber 8C is approximately equal to an atmospheric pressure. When the vaporizable solution in the liquid storage tank 20 is continuously reduced, the pressure in the liquid storage tank 20 is gradually less than the atmospheric pressure. A pressure difference between the vaporization chamber 8C and the liquid storage tank 20 causes the airflow 8*f* to reach a junction of the opening 5*h*4 and the top cap sealing component 4 through the channel 5*v* from the vaporization chamber 8C. The airflow 8*f* may partially push away the top cap sealing component 4. The airflow 8*f* may cause partial deformation of the top cap sealing component 4. The airflow 8*f* may enter the liquid storage tank 20 through a gap generated by the deformation of the top cap sealing component 4. The airflow 8*f* entering the liquid storage tank 20 may increase the pressure in the liquid storage tank 20. The airflow 8*f* entering the liquid storage tank 20 may balance a pressure between the liquid storage tank 20 and the vaporization chamber 8C.

In some embodiments, the heating component top cap 5 may be additionally provided with a channel having a same function as the channel 5*v*. For example, the heating component top cap 5 may also be provided with a ventilation channel close to the opening 5*h*3.

As shown in FIG. 3A, the channel 5*v* has an exterior with a narrow top and a wide bottom. The exterior of the channel 5*v* has many advantages. The channel 5*v* with a narrow top and a wide bottom may accelerate an airflow change. A speed at which the airflow 8*f* leaves a narrow opening (5*h*4) of the channel 5*v* is faster than a speed at which the airflow enters a wide opening (5*h*5) of the channel 5*v*. The accelerated airflow 8*f* may better push open the top cap sealing component 4 and increase efficiency of balancing the pressure between the liquid storage tank 20 and the vaporization chamber 8C.

FIG. 4B is a sectional view of a cartridge according to another embodiment of the present disclosure.

The heating component top cap 5 includes the channel 5*v* composed of a first portion 5*v*1 and a second portion 5*v*2 (refer to FIG. 3F). Because a joint between the second portion 5*v*2 and the first portion 5*v*1 and a bottom surface 5*s*3 are spaced apart by a distance h3, a groove for storing liquid is formed at a bottom of the first portion 5*v*1. In the process of pushing open the top cap sealing component 4 by the airflow 8*f*, if a small amount of e-liquid leaks into the channel 5*v* along a gap 201 from the opening 5*h*4, the groove at the bottom of the first portion 5*v*1 may store the leaked e-liquid, thereby reducing a probability that an electronic component is damaged due to the e-liquid flowing into a body 100B.

Similarly, the first portion 5*v*1 of the channel 5*v* also has an exterior with a narrow top and a wide bottom. The exterior of the first portion 5*v*1 may increase efficiency of balancing the pressure between the liquid storage tank 20 and the vaporization chamber 8C.

Figure 5A:
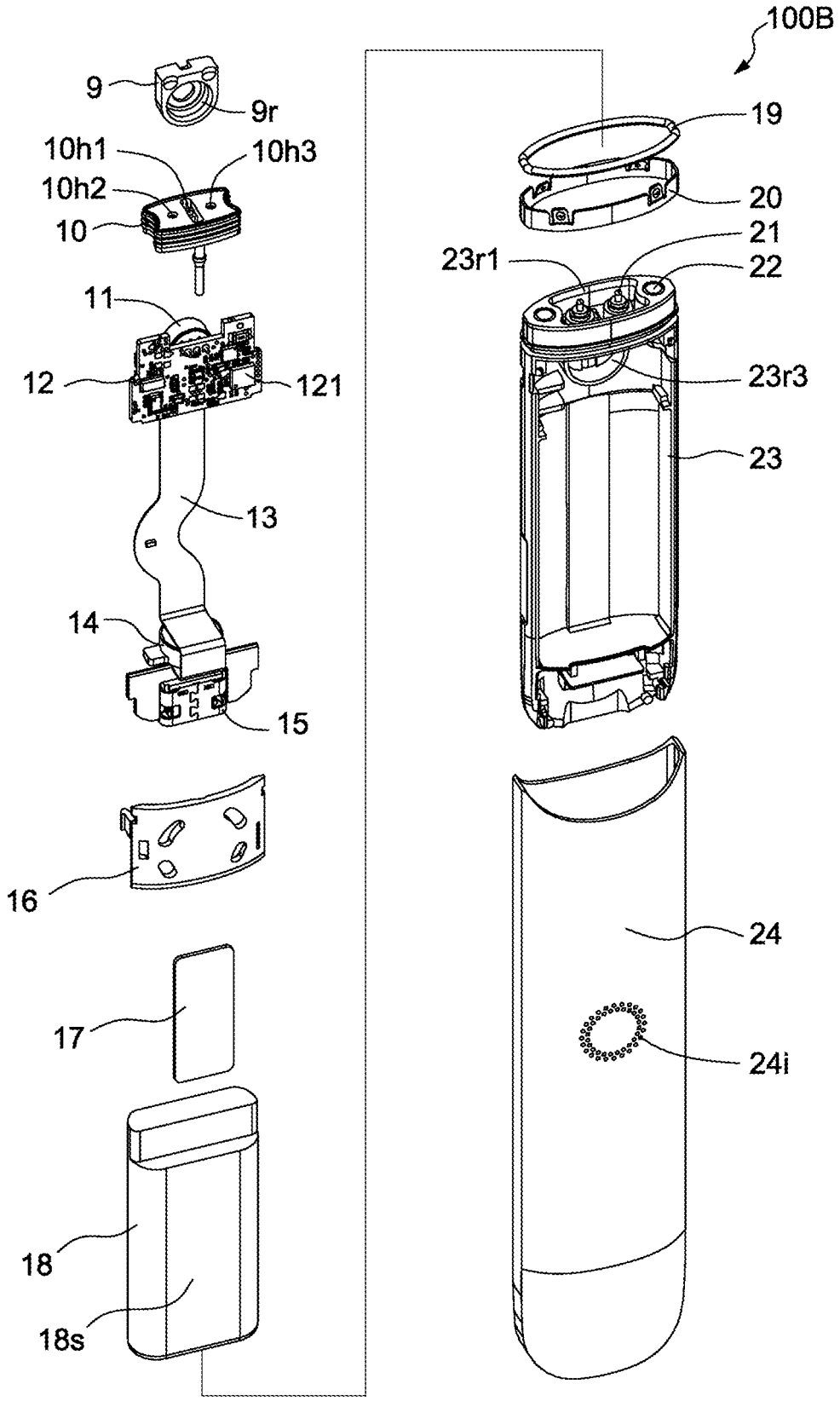
FIG. 5A and FIG. 5B are exploded views of a body of a vaporization device according to some embodiments of the present disclosure.
Figure 5B:
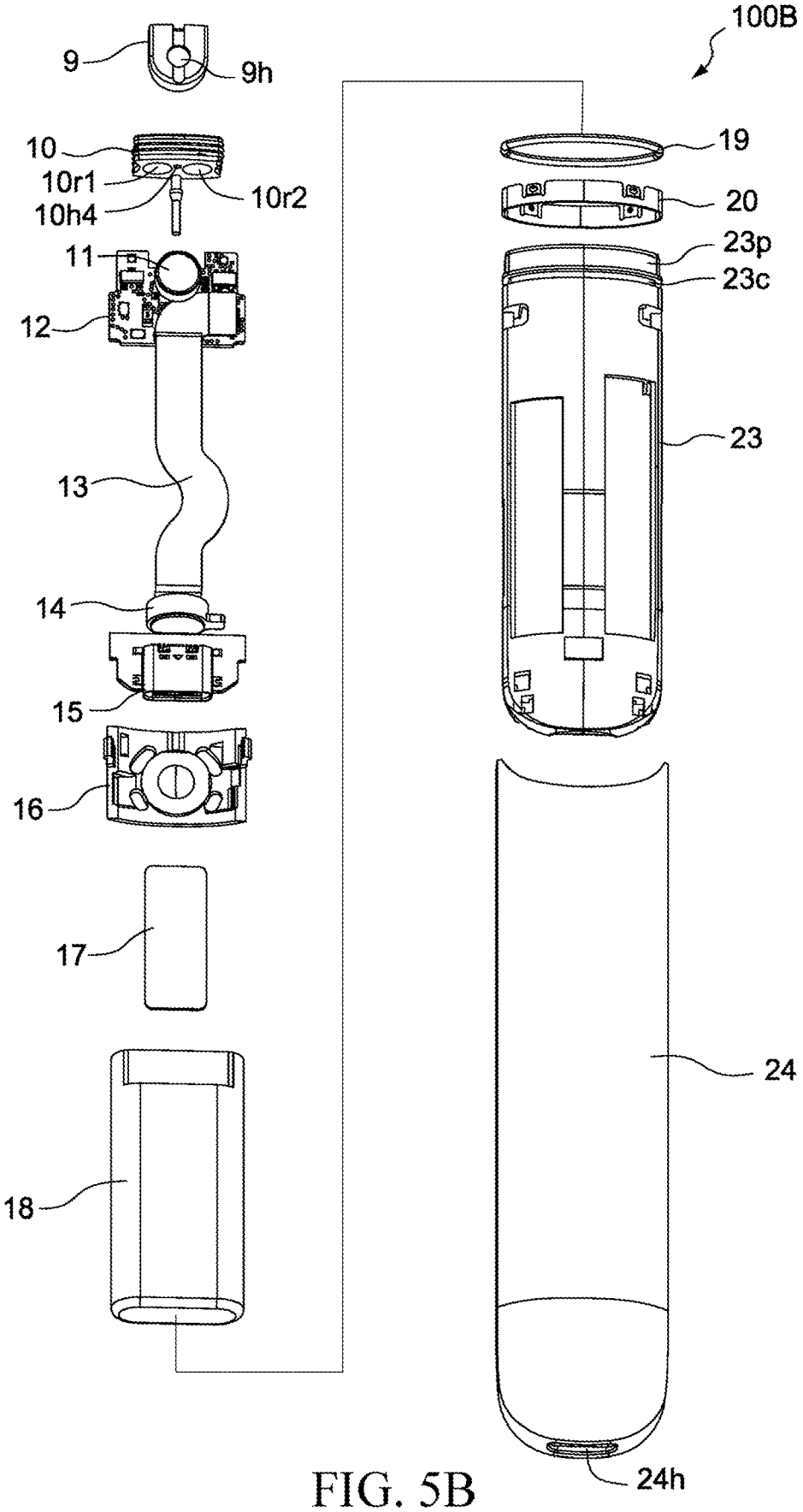

FIG. 5A and FIG. 5B are exploded views of a body of a vaporization device according to some embodiments of the present disclosure.

A body 100B includes a sensor bracket 9, a connecting member 10, a sensor 11, a circuit board 12, a flat cable 13, a vibrator 14, a charging component 15, a circuit board bracket 16, a buffer component 17, a power supply component 18, a sealing component 19, a frame component 20, a conductive pin 21, a magnetic component 22, a power supply component bracket 23, and a body housing 24.

The sensor bracket 9 may be disposed in a groove 23*r*3 of the power supply component bracket 23. A groove 9*r* is disposed on one side of the sensor bracket 9. The sensor 11 may be disposed in the groove 9*r*. An opening 9*h* is disposed on the other side of the sensor bracket 9. The opening 9*h* is in fluid communication with an opening 10*h*1 of the connecting member 10 (refer to FIG. 7B). The opening 9*h* is in fluid communication with an opening 23*h*1 of the power supply component bracket 23 (refer to FIG. 6 and FIG. 7B). The sensor 11 may sense airflow generated when a user inhales via the opening 9*h*.

The connecting member 10 is disposed in a groove 23*r*1 on the top of the power supply component bracket 23. The connecting member 10 may include a silicone material. The connecting member 10 may include a flexible material. The connecting member 10 may provide sealing and buffering functions.

An opening direction of the groove 9*r* is different from an opening direction of the groove 23*r*1. In some embodiments, the opening direction of the groove 9*r* and the opening direction of the groove 23*r*1 may be substantially perpendicular to each other. In some embodiments, an included angle between the opening direction of the groove 9*r* and the opening direction of the groove 23*r*1 is in a range of 85° to 95°.

A top surface of the connecting member 10 has openings 10*h*2 and 10*h*3, and has the opening 10*h*1 between the openings 10*h*2 and 10*h*3. A bottom surface of the connecting member 10 has grooves 10*r*1 and 10*r*2, and has an opening 10*h*4 between the grooves 10*r*1 and 10*r*2. A set of conductive pins 21 may be respectively disposed in the grooves 10*r*1 and 10*r*2 and exposed via the openings 10*h*2 and 10*h*3. The conductive pin 21 may supply power to a heating component 7 in a cartridge 100A.

The opening 10*h*1 penetrates through the connecting member 10 to form a channel. The opening 10*h*1 penetrates through the connecting member 10 to form the opening 10*h*4 on the other side of the connecting member 10. The openings 10*h*1 and 10*h*4 are in communication with each other to form a channel.

The sensor 11 may sense, via the channel between the opening 10*h*1 and the opening 10*h*4, the airflow generated when the user inhales.

The sensor 11 is disposed on the circuit board 12, and the circuit board 12 includes a controller 121. The circuit board 12 is disposed between the circuit board bracket 16 and the power supply component bracket 23.

The controller 121 may be a microprocessor. The controller 121 may be a programmable integrated circuit. The controller 121 may be a programmable logic circuit. In some embodiments, operation logic in the controller 121 cannot be changed after the controller 121 is manufactured. In some embodiments, the operation logic in the controller 121 may be changed programmatically after the controller 121 is manufactured.

The circuit board 12 may also include a memory (not shown). In some embodiments, the memory may be integrated into the controller 121. In some embodiments, the memory may be disposed separately from the controller 121.

The controller 121 may be electrically connected to the sensor 11. The controller 121 may be electrically connected to the conductive pin 21. The controller 121 may be electrically connected to the power supply component 18. When the sensor 11 detects airflow, the controller 121 may control the power supply component 18 to output power to the conductive pin 21. When the sensor 11 detects an atmospheric pressure change, the controller 121 may control the power supply component 18 to output power to the conductive pin 21. When the sensor 11 detects a negative pressure, the controller 121 may control the power supply component 18 to output power to the conductive pin 21. When the controller 121 determines that an atmospheric pressure detected by the sensor 11 is lower than a threshold, the controller 121 may control the power supply component 18 to output power to the conductive pin 21. When the sensor 11 detects an acoustic wave, the controller 121 may control the power supply component 18 to output power to the conductive pin 21. When the controller 121 determines that an amplitude of an acoustic wave detected by the sensor 11 is higher than a threshold, the controller 121 may control the power supply component 18 to output power to the conductive pin 21.

The vibrator 14 may be electrically connected to the controller 121. In some embodiments, the vibrator 14 is electrically connected to the controller 121 on the circuit board 12 via the flat cable 13.

Based on different operating states of a vaporization device 100, the controller 121 may control the vibrator 14 to generate different somatosensory effects. In some embodiments, when the user inhales for more than a specific period of time, the controller 121 may control the vibrator 14 to generate vibration to remind the user to stop inhaling. In some embodiments, when the user charges the vaporization device 100, the controller 121 may control the vibrator 14 to generate vibration to indicate that the charging already starts. In some embodiments, when the charging of the vaporization device 100 is completed, the controller 121 may control the vibrator 14 to generate vibration to indicate that the charging is completed.

The charging component 15 is disposed on a bottom of the body housing 24. One end of the charging component 15 is exposed via an opening 24*h* of the body housing 24. The power supply component 18 may be charged via the charging component 15. In some embodiments, the charging component 15 includes a USB interface. In some embodiments, the charging component 15 includes a USB type-C interface.

The power supply component 18 may be disposed in the power supply component bracket 23. The buffer component 17 may be disposed on a surface 18*s* of the power supply component 18. The buffer component 17 may be disposed between the power supply component 18 and the body housing 24. The buffer component 17 may be in direct contact with the surface 18*s* of the power supply component 18 and an inner wall of the body housing 24. Although not shown in the figure, an additional buffer component may be disposed between the power supply component 18 and the power supply component bracket 23.

In some embodiments, the power supply component 18 may be a battery. In some embodiments, the power supply component 18 may be a rechargeable battery. In some embodiments, the power supply component 18 may be a disposable battery.

The frame component 20 is fixed to an upper periphery 23*p* of the power supply component bracket 23. The frame component 20 may increase friction between the power supply component bracket 23 and the body housing 24. The frame component 20 may fix the power supply component bracket 23 in the body housing 24. The frame component 20 may prevent a component in the body housing 24 from being displaced due to insertion/removal of the power supply component 18 and a charging cable. In some embodiments, the frame component 20 may include a plastic material. In some embodiments, the frame component 20 may include a metal material.

The connecting member 10 is disposed in a groove 23*r*1 on the top of the power supply component bracket 23. The sealing component 19 is disposed in a groove 23*c* of the power supply component bracket 23. The magnetic component 22 is disposed on the top of the power supply component bracket 23. In some embodiments, the magnetic component 22 may be a permanent magnet. In some embodiments, the magnetic component 22 may be an electromagnet. In some embodiments, the magnetic component 22 is magnetic. In some embodiments, the magnetic component 22 is magnetic only after being electrified.

The body housing 24 includes a light transmissive component 24*i*. The light transmissive component 24*i* may include one or more holes penetrating through the body housing 24. In some embodiments, the light transmissive component 24*i* may be substantially circular. In some embodiments, the light transmissive component 24*i* may be substantially rectangular. In some embodiments, the light transmissive component 24*i* may have a symmetrical exterior. In some embodiments, the light transmissive component 24*i* may have an asymmetric exterior. Light emitted by one or more light-emitting components (not shown) on the circuit board 12 is visible through the light transmissive component 24*i*.

Figure 6:
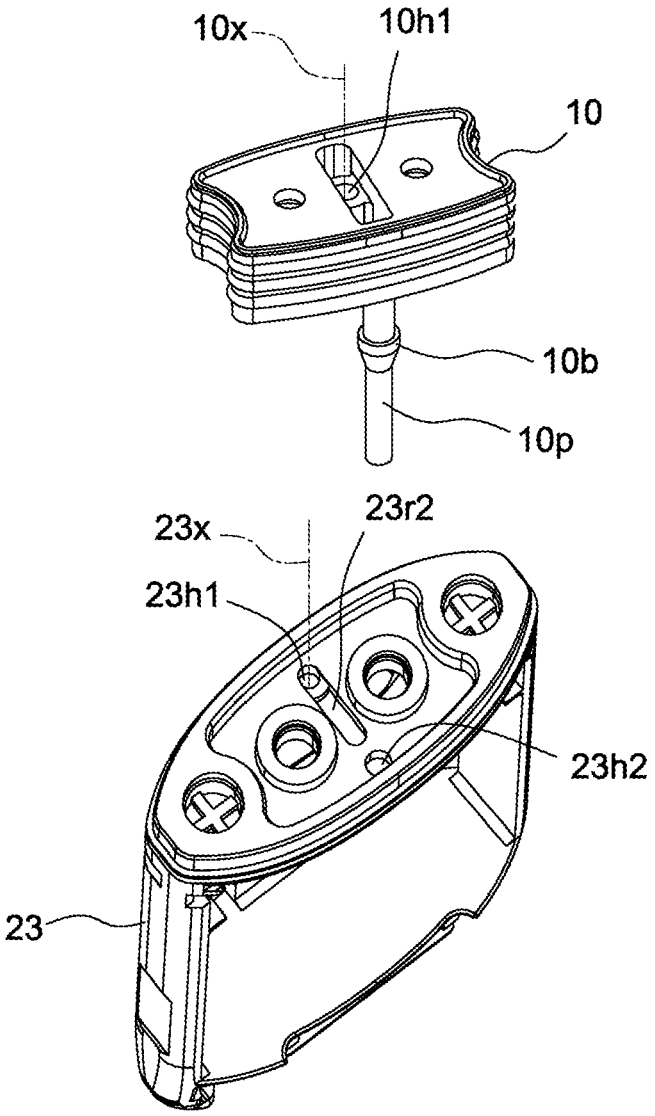
FIG. 6 is a three-dimensional view of a sensor top cap and a power supply component bracket according to some embodiments of the present disclosure.

FIG. 6 is a three-dimensional view of a sensor top cap and a power supply component bracket according to some embodiments of the present disclosure.

As shown in FIG. 6, an opening 10*h*1 of a connecting member 10 penetrates through the connecting member 10 in a direction of an axis 10*x*. The connecting member 10 has an extending portion 10*p* and an annular portion 10*b*.

The extending portion 10*p* has flexibility. The annular portion 10*b* has flexibility. When the connecting member 10 is assembled to a power supply component bracket 23, the extending portion 10*p* and the annular portion 10*b* pass through an opening 23*h*2 on the power supply component bracket 23. The annular portion 10*b* has a larger diameter than the opening 23*h*2. When the annular portion 10*b* passes through the opening 23*h*2, the connecting member 10 and the power supply component bracket 23 may be fixed to each other. The connecting member 10 may be fixed onto the power supply component bracket 23 via the annular portion 10*b*.

The power supply component bracket 23 includes an opening 23*h*1 and a groove 23*r*2. The opening 23*h*1 is adjacent to the groove 23*r*2. The opening 23*h*1 penetrates through the power supply component bracket 23 along a direction of an axis 23*x*.

When the connecting member 10 is assembled to the power supply component bracket 23, the opening 23*h*1 and the opening 10*h*1 do not overlap in a vertical direction. When the connecting member 10 is assembled to the power supply component bracket 23, the axis 10*x* and the axis 23*x* do not overlap. When the connecting member 10 is assembled to the power supply component bracket 23, the axis 10*x* extends through the groove 23*r*2. When the connecting member 10 is assembled to the power supply component bracket 23, the opening 10*h*1 extends through the groove 23*r*2.

The groove 23*r*2 may temporarily store e-liquid leaking from a cartridge 100A, and the groove 23*r*2 may temporarily store condensed liquid leaking from the cartridge 100A. The groove 23*r*2 may reduce contact of the e-liquid or the condensed liquid with an electronic component in a body 100B. The groove 23*r*2 may reduce a failure of the electronic component in the body 100B due to the e-liquid or the condensed liquid.

Figure 7A:
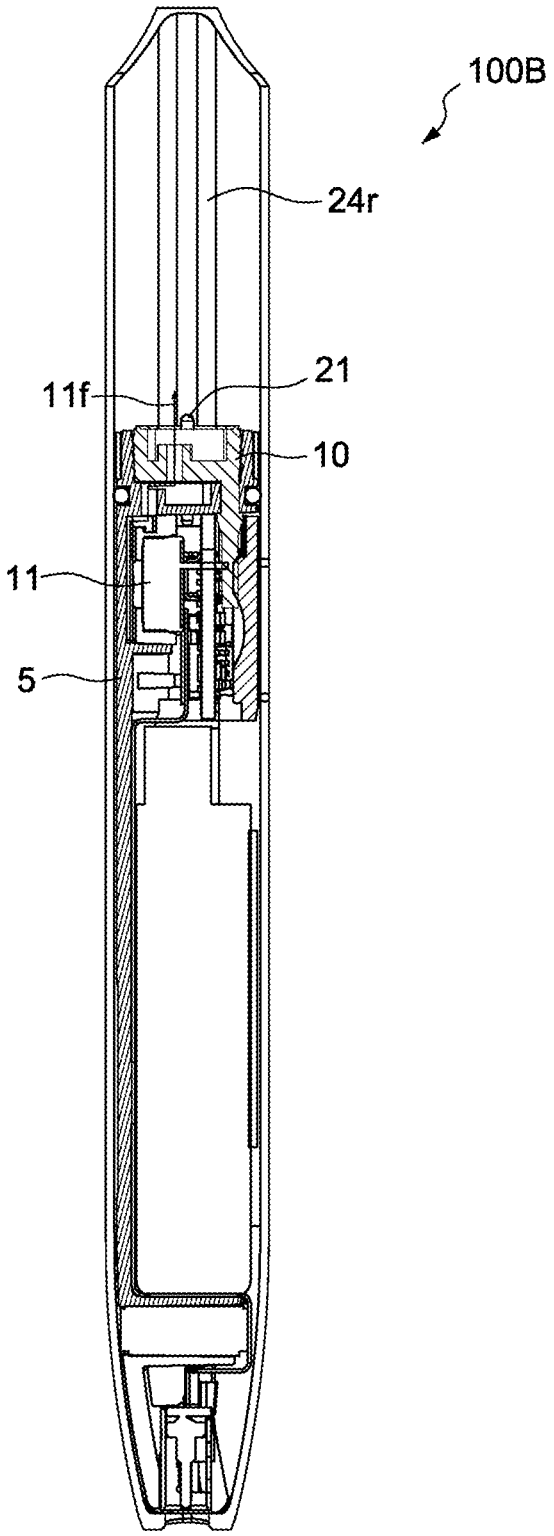
FIG. 7A is a sectional view of a body of a vaporization device according to some embodiments of the present disclosure.

FIG. 7A is a sectional view of a body of a vaporization device according to some embodiments of the present disclosure.

A body 100B has a receiving portion 24*r* that may be used to receive a portion of a cartridge 100A. When the cartridge 100A and the body 100B are engaged with each other, a conductive pin 21 may be in contact with metal pads 8*m*1 and 8*m*2 at the bottom of the cartridge 100A, thereby supplying power to a heating component 7.

When the cartridge 100A is engaged with the body 100B, airflow 11*f* is generated in the body 100B when a user inhales via an opening 1*h*. The airflow 11*f* leaves a connecting member 10 through an opening 10*h*1 of the connecting member 10. The airflow 11*f* enters the receiving portion 24*r* of the body 100B through the opening 10*h*1 of the connecting member 10. The airflow 11*f* may be detected by a sensor 11, and then a controller 121 is enabled to supply a current to the heating component 7.

Figure 7B:
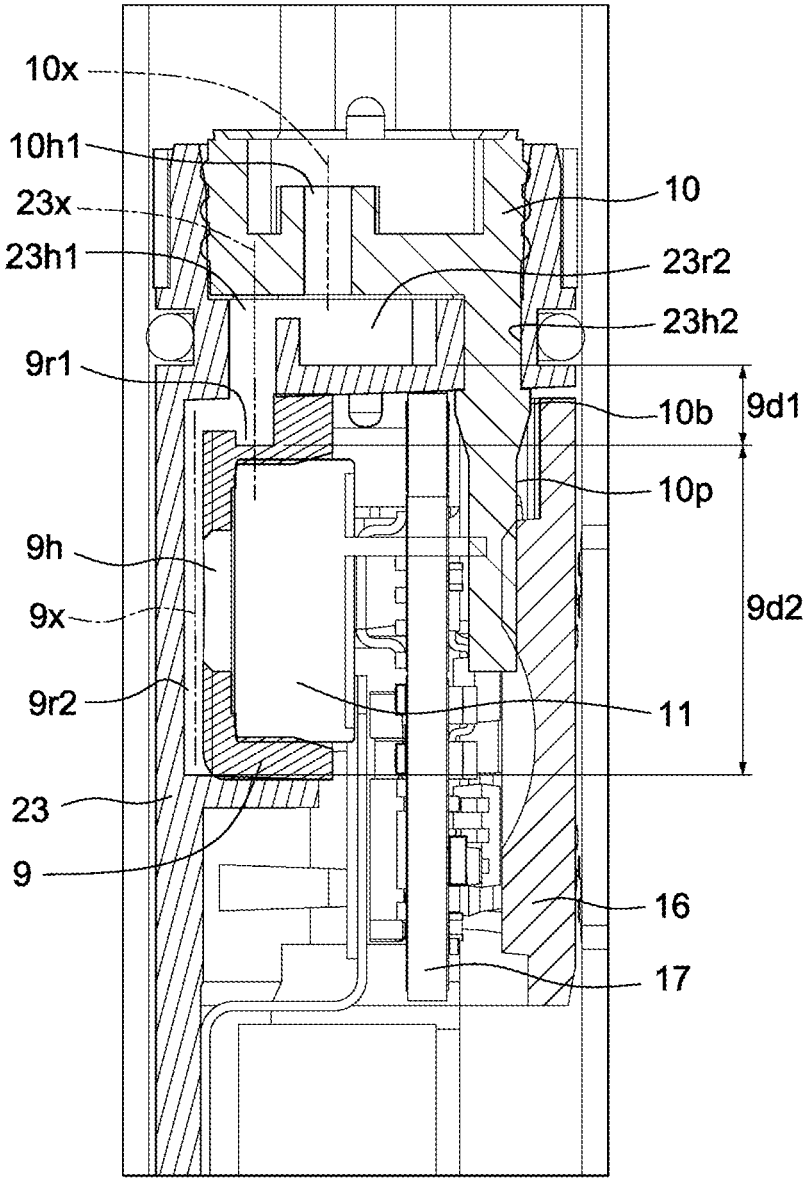
FIG. 7B is a sectional view of a body of a vaporization device according to some embodiments of the present disclosure.

FIG. 7B is a sectional view of a body of a vaporization device according to some embodiments of the present disclosure.

As shown in FIG. 7B, a power supply component bracket 23 has a groove 23*r*2 close to a connecting member 10. If e-liquid or condensed liquid in a cartridge 100A leaks into a body 100B along an opening 10*h*1, the groove 23*r*2 may temporarily receive the liquid to prevent the liquid from being in direct contact with a sensor 11 or other electronic components.

A sensor bracket 9 has a groove 9*r*1. An extending direction of an opening of the groove 9*r*1 is the same as an extending direction of the opening 10*h*1. The extending direction of the opening of the groove 9*r*1 is the same as an extending direction of an opening 23*h*1. The opening 23*h*1 of the power supply component bracket 23 extends through the groove 9*r*1.

If the e-liquid or the condensed liquid in the cartridge 100A leaks into the body 100B along the opening 10*h*1, the groove 9*r*1 may temporarily receive the liquid to prevent the liquid from being in contact with the sensor 11 via an opening 9*h* of the sensor bracket 9. If the e-liquid or the condensed liquid in the cartridge 100A leaks into the body 100B along the opening 10*h*1, the groove 9*r*1 may temporarily receive the liquid to prevent the liquid from being in contact with other electronic components in the body 100B.

The sensor bracket 9 and the power supply component bracket 23 together define a trench 9*r*2. An opening of the trench 9*r*2 faces a direction of the opening 10*h*1. The trench 9*r*2 extends along a direction of an axis 9*x*. The axis 9*x* and an axis 23*x* (refer to FIG. 6) do not overlap. The axis 9*x* and an axis 10*x* (refer to FIG. 6) do not overlap.

If the e-liquid or the condensed liquid in the cartridge 100A leaks into the body 100B along the opening 10*h*1, the trench 9*r*2 may temporarily receive the liquid to prevent the liquid from being in contact with the sensor 11 via the opening 9*h* of the sensor bracket 9. If the e-liquid or the condensed liquid in the cartridge 100A leaks into the body 100B along the opening 10*h*1, the trench 9*r*2 may temporarily receive the liquid to prevent the liquid from being in contact with other electronic components in the body 100B.

In some embodiments, a bottom surface of the groove 23*r*2 and a bottom surface of the groove 9*r*1 may be on a same plane. In some embodiments, the bottom surface of the groove 23*r*2 and the bottom surface of the groove 9*r*1 are not on the same plane. In some embodiments, the bottom surface of the groove 23*r*2 and the bottom surface of the groove 9*r*1 are spaced apart by a distance 9*d*1.

In some embodiments, the bottom surface of the groove 9*r*1 and a bottom surface of the trench 9*r*2 may be on a same plane. In some embodiments, the bottom surface of the groove 9*r*1 and the bottom surface of the trench 9*r*2 are not on the same plane. In some embodiments, the bottom surface of the groove 9*r*1 and the bottom surface of the trench 9*r*2 are spaced apart by a distance 9*d*2.

The bottom surface of the groove 23*r*2 and the bottom surface of the trench 9*r*2 are spaced apart by a distance (9*d*1+9*d*2).

The non-coplanarity of the bottom surface of the groove 23*r*2 and the bottom surface of the groove 9*r*1 may bring many advantages. The non-coplanarity of the bottom surface of the groove 9*r*1 and the bottom surface of the trench 9*r*2 may bring many advantages.

The bottom surface of the groove 23*r*2 and the bottom surface of the groove 9*r*1 are not coplanar, so that the e-liquid or the condensed liquid entering the body 100B via the opening 10*h*1 needs to change a direction several times to reach the opening 9*h*. The bottom surface of the groove 23*r*2 and the bottom surface of the groove 9*r*1 are not coplanar, so that a failure probability of the sensor 11 can be reduced.

The bottom surface of the groove 9*r*1 and the bottom surface of the trench 9*r*2 are not coplanar, so that the e-liquid or the condensed liquid entering the body 100B via the opening 10*h*1 needs to change a direction several times to reach the opening 9*h*. The bottom surface of the groove 9*r*1 and the bottom surface of the trench 9*r*2 are not coplanar, so that a failure probability of the sensor 11 can be reduced.

As used herein, space-related terms such as "under", "below", "lower portion", "above", "upper portion", "lower portion", "left side", "right side", and the like may be used herein to simply describe a relationship between one component or feature and another component or feature as shown in the figures. In addition to orientation shown in the figures, space-related terms are intended to encompass different orientations of the device in use or operation. An apparatus may be oriented in other ways (rotated 90 degrees or at other orientations), and the space-related descriptors used herein may also be used for explanation accordingly. It should be understood that when a component is "connected" or "coupled" to another component, the component may be directly connected to or coupled to another component, or an intermediate component may exist.

As used herein, the terms "approximately", "basically", "substantially", and "about" are used to describe and explain small variations. When used in combination with an event or a situation, the terms may refer to an example in which an event or a situation occurs accurately and an example in which the event or situation occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all ranges disclosed herein include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

As used herein, the terms "approximately", "basically", "substantially", and "about" are used to describe and explain small variations. When used in combination with an event or a situation, the terms may refer to an example in which an event or a situation occurs accurately and an example in which the event or situation occurs approximately. For example, when being used in combination with a value, the term may refer to a variation range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, if a difference between two values is less than or equal to ±10% of an average value of the value (for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%), it could be considered that the two values are "substantially" the same. For example, being "substantially" parallel may refer to an angular variation range of less than or equal to ±10° with respect to 0°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, being "substantially" perpendicular may refer to an angular variation range of less than or equal to ±10° with respect to 90°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

For example, two surfaces can be deemed to be coplanar or substantially coplanar if a displacement between the two surfaces is no greater than 5 μm, no greater than 2 μm, no greater than 1 μm, or no greater than 0.5 μm. A surface can be deemed to be planar or substantially planar if a difference between any two points on the surface is no greater than 5 μm, no greater than 2 μm, no greater than 1 μm, or no greater than 0.5 μm.

As used herein, the terms "conductive", "electrically conductive", and "electrical conductivity" refer to an ability to transport an electric current. Electrically conductive materials typically indicate those materials that exhibit little or no opposition to the flow of an electric current. One measure of electrical conductivity is Siemens per meter (S/m). Typically, an electrically conductive material is one having a conductivity greater than approximately $10^4$ S/m, such as at least $10^5$ S/m or at least $10^6$ S/m. The electrical conductivity of a material can sometimes vary with temperature. Unless otherwise specified, the electrical conductivity of a material is measured at room temperature.

As used herein, the singular terms "a/an" and "the" may include plural referents unless the context clearly dictates otherwise. In the description of some embodiments, components provided "on" or "above" another component may encompass a case in which a former component is directly on a latter component (for example, in physical contact with the latter component), and a case in which one or more intermediate components are located between the former component and the latter component.

Unless otherwise specified, spatial descriptions such as "above", "below", "upper", "left", "right", "lower", "top", "bottom", "vertical", "horizontal", "side", "higher", "lower", "upper portion", "on", "under", and "downward" are indicated relative to the orientations shown in the figures. It should be understood that the space descriptions used herein are merely for illustrative purposes, and actual implementations of the structures described herein may be spatially arranged in any orientation or manner, provided that the advantages of embodiments of the present disclosure are not deviated due to such arrangement.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not be necessarily drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Therefore, unless otherwise specifically indicated herein, the order and grouping of operations shall not be construed as any limitation on the present application.

Several embodiments of the present disclosure and features of details are briefly described above. The embodiments described in the present disclosure may be easily used as a basis for designing or modifying other processes and structures for realizing the same or similar objectives and/or obtaining the same or similar advantages introduced in the embodiments of the present disclosure. Such equivalent construction does not depart from the spirit and scope of the present disclosure, and various variations, replacements, and modifications can be made without departing from the spirit and scope of the present disclosure.

What is claimed is:

1. A vaporization device, comprising:

a body housing comprising a receiving portion;

a first bracket disposed in the body housing and comprising a first groove, a second groove, a third groove, and a first opening adjacent to the second groove;

a connecting member disposed in the first groove and comprising a first opening; and a second bracket disposed in the third groove of the first bracket;

the first opening of the connecting member extending in a direction of a first axis, and the first opening of the first bracket extending in a direction of a second axis, wherein the first axis and the second axis do not overlap.

2. The vaporization device according to claim 1, wherein the second bracket comprises a first groove, and a bottom surface of the first groove of the second bracket and a bottom surface of the second groove of the first bracket are spaced apart by a first distance.

3. The vaporization device according to claim 2, wherein the first bracket and the second bracket define a trench, and a bottom surface of the trench and the bottom surface of the first groove of the second bracket are spaced apart by a second distance.

4. The vaporization device according to claim 3, the trench extending in a direction of a third axis, wherein the third axis and the second axis do not overlap.

5. The vaporization device according to claim 1, wherein an extending direction of the first opening of the connecting member passes through the second groove of the first bracket.

6. The vaporization device according to claim 1, wherein an extending direction of the first opening of the first bracket passes through the first groove of the second bracket.

7. The vaporization device according to claim 1, wherein the first bracket further comprises a first opening, and the connecting member further comprises an extension portion and an annular portion, wherein the extension portion is disposed in the first opening of the first bracket.

8. The vaporization device according to claim 7, wherein the connecting member is fixed to the first bracket through the annular portion.

9. The vaporization device according to claim 1, wherein the second bracket comprises an opening, and the opening of the second bracket is in fluid communication with the first opening of the connecting member.

10. The vaporization device according to claim 1, further comprising a sensor disposed in the second bracket, the sensor being configured to detect airflow leaving the connecting member from the first opening of the connecting member.

11. The vaporization device according to claim 1, further comprising a cartridge disposed in the receiving portion, and the cartridge comprising:

a heating component top cap, a heating component base, a first sealing member disposed on the heating component top cap, and a heating component disposed between the heating component top cap and the heating component base, the heating component top cap comprising a first opening on a first surface and a second opening on a second surface, wherein the first sealing member covers the first opening and exposes the second opening.

12. The vaporization device according to claim 11, wherein a diameter of the first opening is less than a diameter of the second opening, and the first opening and the second opening form a first channel in the heating component top cap.

13. The vaporization device according to claim 12, wherein an inner diameter of the first channel gradually increases in a direction from the first surface to the second surface.

14. The vaporization device according to claim 12, wherein the heating component and the heating component base define a vaporization chamber, and the first channel is in fluid communication with the vaporization chamber.

15. A vaporization device, comprising:

a body housing;

a first bracket disposed in the body housing and comprising a first groove, a second groove, and a first opening adjacent to the second groove; and a connecting member disposed in the first groove and comprising a first opening; wherein an extending direction of the first opening of the connecting member does not pass through the first opening of the first bracket.

16. The vaporization device according to claim 15, further comprising a second bracket, the second bracket comprising a first groove, wherein an extending direction of the first opening of the first bracket passes through the first groove of the second bracket.

17. The vaporization device according to claim 16, wherein the first bracket and the second bracket define a trench, and a direction in which the trench extends and a direction in which the first opening of the first bracket extends do not overlap.

18. The vaporization device according to claim 16, wherein the first bracket and the second bracket define a trench, and a direction in which the trench extends and a direction in which the first opening of the connecting member extends do not overlap.

19. The vaporization device according to claim 15, further comprising:

a cartridge partially received in the body housing and comprising:

a heating component top cap and a first sealing member disposed on the heating component top cap, the heating component top cap comprising a first channel and a second channel, wherein the first sealing member exposes the first channel and covers the second channel on a first surface of the heating component top cap.

20. The vaporization device according to claim 19, wherein the second channel comprises a first portion and a second portion, and a joint between the second portion and the first portion and a bottom surface of the first portion is spaced apart by a first distance.

* * * * *